United States Patent [19]

Vitale

[11] 4,338,693

[45] Jul. 13, 1982

[54] ONE-PIECE QUILTED MATTRESS SHIELD

[75] Inventor: Joseph W. Vitale, Charlotte, N.C.

[73] Assignee: Perfect Fit Industries, Inc., Monroe, N.C.

[21] Appl. No.: 113,151

[22] Filed: Jan. 18, 1980

Related U.S. Application Data

[63] Continuation of Ser. No. 715,732, Aug. 19, 1976, abandoned, which is a continuation-in-part of Ser. No. 539,131, Jan. 7, 1975, abandoned.

[51] Int. Cl.[3] ..... A47G 9/02

[52] U.S. Cl. ..... 5/500; 5/497

[58] Field of Search ..... 5/495, 496, 497, 498, 5/485, 482, 499, 500, 501, 502

[56] References Cited

U.S. PATENT DOCUMENTS

| | | | |
|---|---|---|---|
| 1,339,738 | 5/1920 | Callahan | 5/484 |
| 2,162,755 | 6/1939 | Shauer | 5/497 |
| 2,757,389 | 8/1956 | King | 5/496 |
| 3,156,280 | 11/1964 | Affholter | 5/497 |
| 3,162,868 | 12/1964 | Cramer | 5/499 |
| 3,273,175 | 9/1966 | Anderson et al. | 5/497 |
| 3,666,599 | 5/1972 | Obeda | 156/73.2 |
| 3,900,909 | 8/1975 | Monier et al. | 5/496 |

FOREIGN PATENT DOCUMENTS

| | | | |
|---|---|---|---|
| 887521 | 1/1962 | United Kingdom | 5/497 |
| 1263369 | 2/1972 | United Kingdom | 5/497 |

*Primary Examiner*—Alexander Grosz

*Attorney, Agent, or Firm*—Seidel, Gonda, Goldhammer & Panitch

[57] ABSTRACT

All four corners of a single rectangular piece of quilted material are notched to form a mattress shield blank. The blank has a rectangular center portion substantially the same size as the top of the mattress to be covered, two side portions substantially the same size as the sides of the mattress and two end portions which are larger than the ends of the mattress. Each of the side and end portions are folded downwardly to form the sides and ends of the mattress shield and each pair of abutting side and end portions are secured together to form four vertical corners. The end flaps or the remaining parts of the end portions are then folded inwardly so as to be parallel to the top portion. These flaps are adapted to cover a portion of the bottom of the mattress and are secured to the side portions adjacent the edges of the flaps. In a second embodiment, the side portions are also provided with flaps which are secured at their edges to the edges of the end flaps.

1 Claim, 11 Drawing Figures

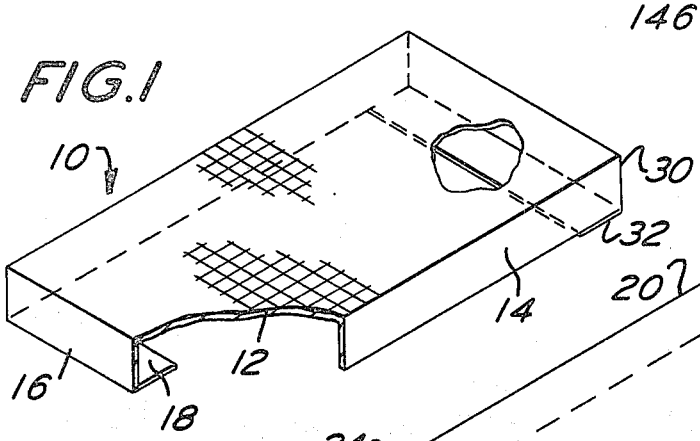
FIG.1
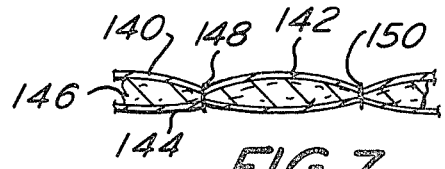
FIG.7
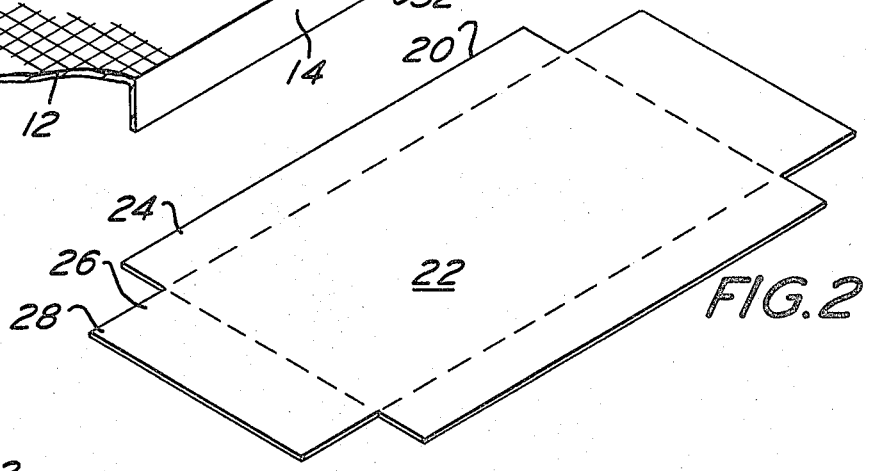
FIG.2
FIG.3
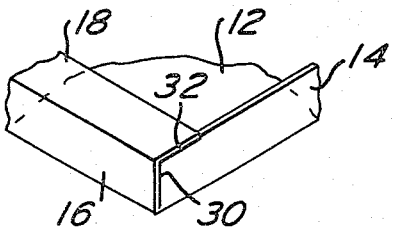
FIG.4
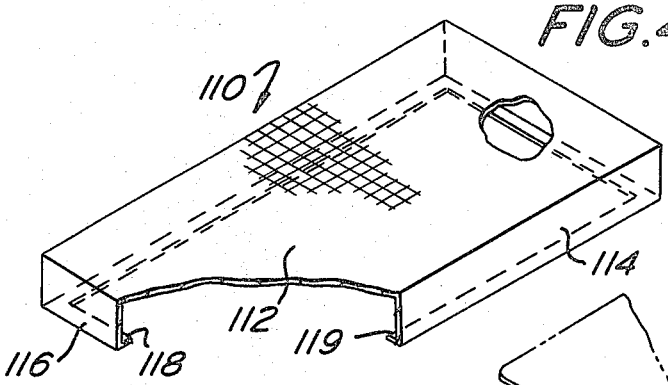
FIG.6
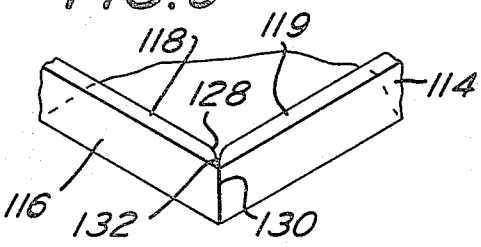
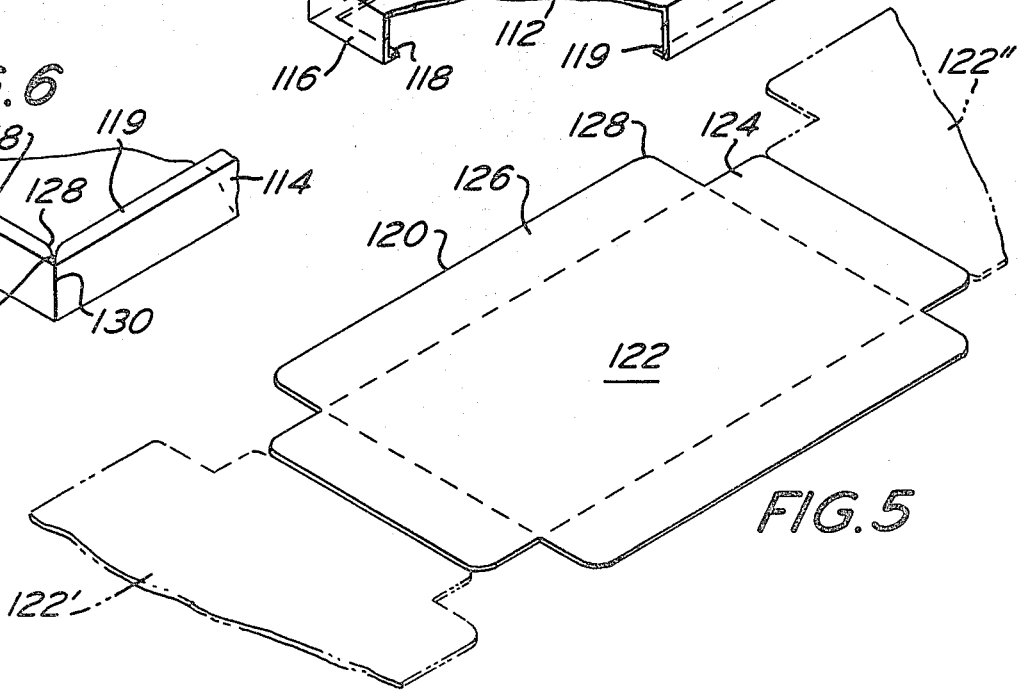
FIG.5

ONE-PIECE QUILTED MATTRESS SHIELD

CO-PENDING APPLICATION

This is a continuation of application Ser. No. 715,732, now abandoned, filed Aug. 19, 1976 which is a continuation-in-part of application Ser. No. 539,131 filed Jan. 7, 1975, now abandoned.

BACKGROUND

Various types of mattress shields or covers have been employed in the past to provide varying but limited amounts of protection for a mattress. The original mattress cover was a single pad substantially the same size as the top of the mattress and was designed to protect the sleeper from protruding buttons on the mattress. These mattress pads provide no protection for the sides or ends of the mattress. In addition, the pads provide no protection on the edges of the underside of the mattress which is needed to prevent scuffing caused by tucking in the bedding. Furthermore, since the mattress pad merely lays on top of the mattress, it easily dislodges itself and therefore requires additional time and effort to readjust or reinstall the same each time the bed is made up.

In an effort to overcome some of the deficiencies of the mattress pad, mattress covers have been made which consist of a flat pad similar to a mattress pad and an additional strip or piece of thin fabric material around the outside edge of the pad in the form of a skirt. This additional skirt material is conventionally sewn to the mattress pad around the peripheral outside edge thereof and hangs down over the sides and ends of the mattress. A drawstring or elastic band around the hem of the skirt is also frequently used to provide a method of affixing the mattress cover to the mattress.

While the just described mattress cover is an improvement over the mattress pad, it is deficient for several reasons. It is more difficult and expensive to manufacture since it utilizes two different materials which must be sewn together. In addition, the seam where the two materials are sewn together is adjacent the top of the mattress. This causes an annoying projection on the top of the mattress. Furthermore, the useful life of these mattress covers are relatively short since the seams are easily split. Even further, these mattress covers provide little or no protection for the sides and ends of the mattress.

One piece contour bed sheets which rely on an elastic strip are known from U.S. Pat. Nos. 3,273,175; 2,162,755 and British Pat. No. 887,521. A similar contour bed sheet which lacks an elastic strip but attains elasticity by using a two-way stretch fabric is known from U.S. Pat. No. 3,789,441. A quilted cover pad which overlies a mattress with a discrete waterproof layer therebetween is disclosed in U.S. Pat. No. 1,339,738.

DISCLOSURE

This invention relates to a one-piece quilted mattress shield. More particularly, the invention relates to a quilted mattress shield which covers the top, sides, ends and a portion of the bottom of a mattress adjacent each end thereof. In addition, the invention relates to a simple yet novel and unobvious method for making the one-piece quilted mattress shield which method is well suited to an automatic assembly line type process.

The present invention is designed to overcome all of the above defects of the prior art and provides a mattress shield which covers the top, sides, ends, and a portion of the bottom of the mattress. In addition, the new mattress shield can be constructed much more economically than the prior art mattress covers since it utilizes a single piece of material and therefore eliminates the seams from the sides and ends of the top of the mattress. The mattress shield of the present invention is constructed by first cutting a rectangular piece of quilted material from a roll of such material. Thereafter, all four corners of the rectangular piece of quilted material are notched to form a mattress shield blank. The blank has a rectangular center portion substantially the same size as the top of the mattress to be covered, two side portions substantially the same size as the sides of the mattress and two end portions which are larger than the ends of the mattress. Each of the side and end portions are folded downwardly to form the sides and ends of the mattress shield and each pair of abutting side and end portions are secured together to form four vertical corners. The end flaps which are the remaining parts of the end portions are then folded inwardly so as to be parallel to the top portion. These flaps are adapted to cover a portion of the bottom of the mattress and are secured to the side portions adjacent the edges of the flaps. In a second embodiment of the invention, side portions are also provided with flaps which are secured at their edges to the edges of the end flaps.

For the purpose of illustrating the invention, there are shown in the drawings forms which are presently preferred; it being understood, however, that this invention is not limited to the precise arrangements and instrumentalities shown.

FIG. 1 is a perspective view, partially broken away, of a mattress shield constructed according to the principles of the present invention.

FIG. 2 is a mattress shield blank from which a mattress shield is constructed;

FIG. 3 is a partial perspective view of the underside of FIG. 1 showing the manner in which the corners of a mattress shield are constructed.

FIG. 4 is a perspective view, partially broken away, of a second embodiment of the invention;

FIG. 5 is a perspective view of a mattress shield blank which is used to construct the mattress shield shown in FIG. 4;

FIG. 6 is a perspective view of a portion of the bottom of FIG. 4 showing the manner in which the corners are constructed.

FIG. 7 is a cross sectional view of the quilted material from which the mattress shield of the present invention is constructed.

Figure 8:
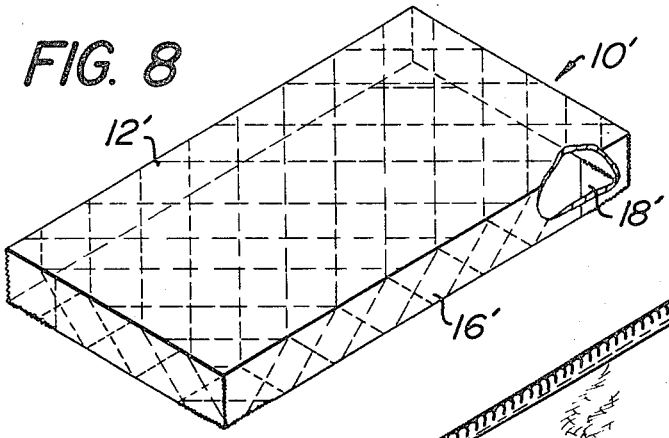
FIG. 8 is a top perspective view, similar to FIG. 1 but showing another embodiment of the invention.

Referring to the drawings in detail wherein like numerals indicate like elements, there is shown in FIG. 1 a mattress shield constructed in accordance with one embodiment of the present invention and indicated generally as 10. The mattress shield includes a top rectangular portion 12 which is substantially the same size as the top of the mattress to be protected. Side wall portions 14 which are integral with the rectangular top portion 12 depend downwardly therefrom and are adapted to substantially cover and protect the sides of the mattress. Similarly, end wall portions 16 are also integral with the top portion 12 and depend downwardly therefrom to cover and protect the foot and head portions of the mattress. Integral with each end portion 16 is a bottom flap portion 18 which is adapted to be inserted beneath the mattress to protect a portion of the bottom thereof. It should be understood that the mattress shield of the present invention is constructed from a flexible quilted material and will therefore only have the shape shown in FIG. 1 when the shield is applied to a mattress or similar form. However, for the sake of clarity, the mattress has not been shown in the figures.

FIG. 2 shows a mattress shield blank 20 which is used to construct the novel mattress shield of the present invention. The blank is prepared by cutting a V-shaped notch, as shown, from each of the corners of a single rectangular piece of quilted material. This leaves a center rectangular portion 22 which will form the top of the mattress shield, side portions 24 which will form the sides of the shield and end portions 26 and 28 which will form the end and bottom flap portions, respectively. The mattress shield 10 is constructed by first folding the side and end portions 24 and 26 of blank 20 downwardly. Adjacent edges of each end and side portion are then joined together to form the vertical corner junctions shown at 30. Thereafter, the end flaps 28 are folded inwardly to form the bottom flap portions 18. The side edges of the bottom flap 18 are then secured to the bottom edge of the side wall portions 14 to form a seam or joint 32. The seams 30 and 32 can be made using any conventional technique. However, if the outer layers of the quilted material used to form the mattress shield 10 are thermoplastic, it is preferred to use ultrasonic sealing to form the seams since this technique is highly economical and is readily adaptable to an entirely automatic system for manufacturing the mattress shields. Ultrasonic sealing techniques are known in the art and accordingly a detailed discussion of the same will be omitted. Typical ultrasonic sealing systems are described in U.S. Pat. Nos. 3,666,599 and 3,733,238.

FIG. 4 illustrates a second embodiment of a mattress shield constructed in accordance with the principles of the present invention which mattress shield is generally indicated at 110. Similar to mattress shield 10, shield 110 includes a top rectangular portion 112 for covering the top of the mattress, side wall portions 114 and end wall portions 116. In addition, mattress shield 110 includes bottom side and end portions 119 and 118, respectively, which are adapted to cover the entire periphery of the bottom surface of the mattress.

The mattress shield 110 of this embodiment is constructed in a similar manner to that of mattress shield 10. As shown in FIG. 5, V-shaped notches are cut from each of the four corners of a single rectangular piece of quilted material to form a mattress shield blank 120. Mattress shield blank 120 includes a center rectangular portion 122 which is substantially the same size as the top of the mattress to be covered. In addition, blank 120 includes end and side portions 124 and 126, respectively. Each of the side and end portions 124 and 126 are slightly larger than the respective side and end faces of the mattress. The additional amount of material remaining on the side and end portions 126 and 124 are used to form the bottom peripheral portions 118 and 119. To this end, each of the outer corners of the end and side portions 124 and 126 are rounded such as shown at 128 in FIG. 5.

After forming the mattress shield blank 120 shown in FIG. 5, the end and side portions 124 and 126 are folded downwardly and adjoining edges of each of the side and end portions are secured together to form vertical seams 130 at each of the corners of the mattress shield 110. Thereafter, the remaining material on the end and side portions 124 and 126 is folded inwardly to form the bottom peripheral edge portions 118 and 119. Adjoining edges of the bottom peripheral portions 118 and 119 are then secured together to form seams 132. It will be understood that seams 130 and 132 may be made in the same manner as seams 30 and 32 described above.

A partial cross sectional view of the quilted material used to make the mattress shield of the present invention is shown in FIG. 7. This quilted material 140 includes upper and lower layers 142 and 144. These upper and lower layers 142 and 144 may be comprised of a woven or non-woven fabric of a thermoplastic material. Located between the upper and lower layers 142 and 144 is a filler or padding material 146. The upper and lower layers 142 and 144 are held together by stitches such as shown at 148 and 150 and which is conventional in the art may form a design or pattern on the outer sides of the quilted material 140.

Referring again to FIG. 5, it can be seen that the method of the present invention is easily adapted to an automatic assembly line type manufacturing process. FIG. 5 shows a plurality of mattress shield blanks positioned end to end and identified as 122, 122' and 122''. Each of these blanks is cut from quilted material which may be continuously or intermittently fed from a roll of quilted material located adjacent one end of the assembly line. Preferably, the notches or corners are first cut from adjoining mattress shield blanks such as 120 and 122' before the two blanks are severed from each other. Thereafter, adjoining blanks may be severed and moved down the assembly line for the folding and seaming steps. While it is possible to use any conventional cutting or stamping means to make the notched corners and to sever adjoining mattress shield blanks from each other, it is preferred to use ultrasonic cutting when thermoplastic quilted material is employed.

In FIGS. 8–11 there is disclosed another shield in accordance with the invention designated generally as 10'. Shield 10' is the same as shield 10 shown in FIGS. 1–3 and 7 except as follows. Hence, corresponding elements are designated with corresponding primed numerals.

Figure 10:
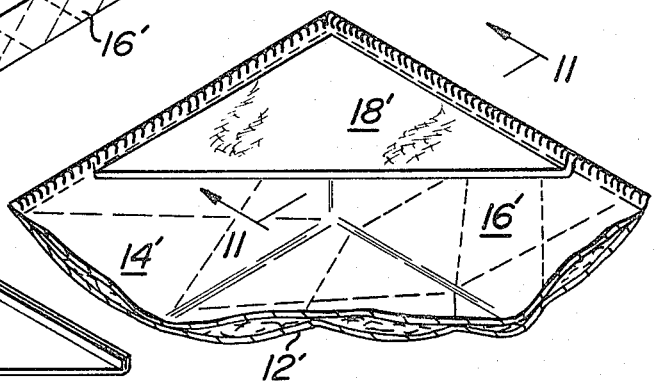
FIG. 10 is a bottom perspective view of a corner of the shield in FIG. 8.
Figure 9:
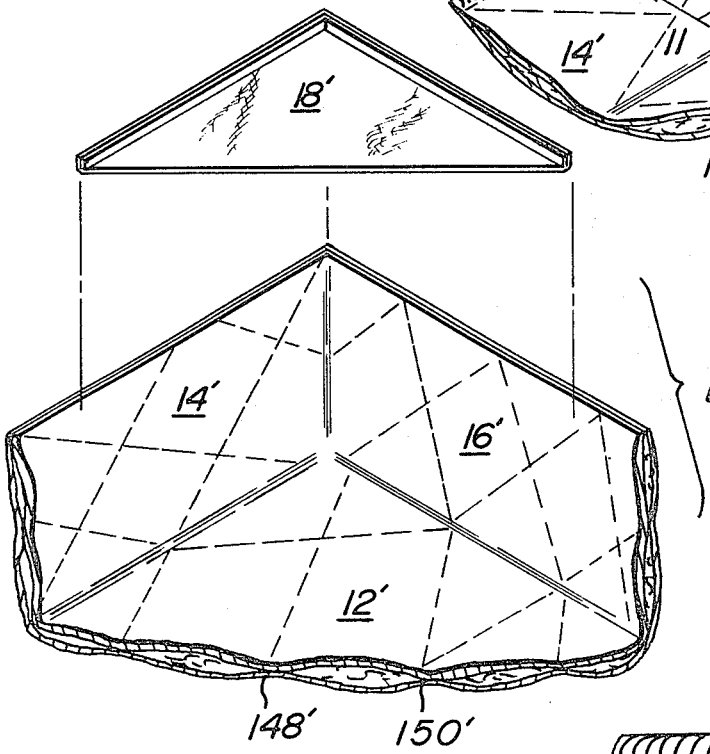
FIG. 9 is an exploded view of a corner of the shield in FIG. 8.
Figure 11:
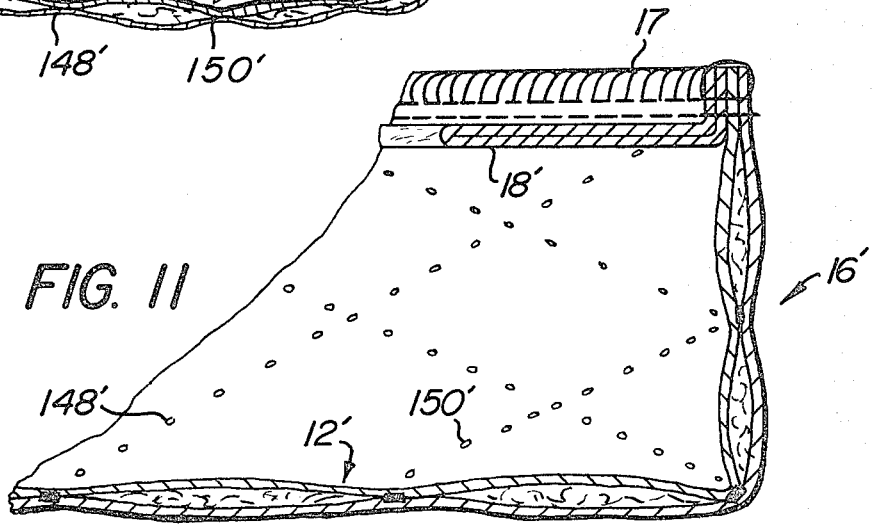
FIG. 11 is a sectional view taken along the line 11—11 of FIG. 10.

The shield 10' has bottom portions 18' which are in the shape of a right triangle. Bottom portions 18 are formed from a rectangular piece of fabric, preferably the same as fabric layers 140, 144, folded over so that the hypothenuse is a fold line. The other two edges of the bottom portion 18', as shown in FIG. 10 are stitched by overlock stitching 17 to the adjacent edges of sidewall portion 14' and end wall portion 16'. Stitching 17 is provided to finish the raw exposed edges of layers 140, 144 and 146 and therefore no additional stitching is needed to join the bottom portions 18'. A bottom portion 18' is provided at each corner of the shield 10'. Since bottom portions 18' are the only portions which are not quilted, the mattress will lie flatter.

It can be seen that the novel mattress shield of the present invention overcomes all of the problems of the prior art and provides protection for the top, sides, ends and a portion of the bottom of the mattress without relying on elasticity of any component. Furthermore, the mattress shield can be easily applied to or removed from the mattress and once affixed to a mattress it is held firmly in place by the bottom flap portions which underlie the peripheral edge of the bottom of the mattress. In addition, there are no seams along the top peripheral edge of the mattress which could rip or protrude to create an uncomfortable sleeping surface. Even further, a mattress shield of the present invention can be manufactured much more economically than prior art devices since only one type of material is utilized and only very limited amount of manual labor is required to construct the mattress shield.

The present invention may be embodied in other specific forms without departing from the spirit or essential attributes thereof and, accordingly, reference should be made to the appended claims, rather than to the foregoing specification as indicating the scope of the invention.

I claim:

1. A quilted mattress shield comprising:

a quilted top portion substantially the same size and shape of the top of the mattress which it is adapted to cover;

a pair of quilted sidewall portions depending from and integral with said top portion, said quilted sidewall portions being adapted to cover the sidewalls of the mattress;

a pair of quilted end wall portions depending from and integral with said top portion, said quilted end wall portions being adapted to cover the end walls of the mattress;

means securing adjacent side edges of each pair of side and end walls portions together to form the vertical corners of the mattress shield;

a plurality of non-elastic bottom portions each having at least two layers of fabric, each bottom portion being connected to at least one of the end and sidewall portions and being generally parallel to said top portion for contact with only a peripheral corner portion of the bottom surface of the mattress;

said bottom portions being right triangular in configuration and connected to the corners of the shield;

each triangular bottom portion being formed by a diagonal fold line of a rectangular piece of material, the side edges of the triangular portion being joined by stitch means to adjacent edges of said side and end wall portions.

* * * * *